US006318096B1

(12) United States Patent
Gross et al.

(10) Patent No.: US 6,318,096 B1
(45) Date of Patent: Nov. 20, 2001

(54) SINGLE SENSOR MIXING BOX AND METHODOLOGY FOR PREVENTING AIR HANDLING UNIT COIL FREEZE-UP

(75) Inventors: Richard J. Gross, Akron, OH (US); Steven P. Rooke, Fishers, IN (US); Patrick Lenahan; David W. Mullen, both of Columbus, OH (US)

(73) Assignee: The University of Akron, Akron, OH (US)

( * ) Notice: Subject to any disclaimer, the term of this patent is extended or adjusted under 35 U.S.C. 154(b) by 0 days.

(21) Appl. No.: 09/655,248

(22) Filed: Sep. 5, 2000

(51) Int. Cl.[7] ..... G05D 23/13
(52) U.S. Cl. ..... 62/122; 165/249; 236/13
(58) Field of Search ..... 62/122, 187; 236/13; 165/248, 249, 257, 291

(56) References Cited

U.S. PATENT DOCUMENTS

| | | | | |
|---|---|---|---|---|
| 3,883,071 | | 5/1975 | Meckler | 236/49 |
| 4,037,783 | * | 7/1977 | Bradford | 165/249 |
| 4,136,822 | | 1/1979 | Felter | 236/49 |
| 4,255,176 | | 3/1981 | Macrow | 55/415 |
| 4,437,609 | | 3/1984 | Johannson | 236/49 |
| 4,506,514 | * | 3/1985 | Lamar et al. | 165/248 |
| 4,537,035 | | 8/1985 | Stiles | 62/89 |
| 4,605,160 | * | 8/1986 | Day | 236/13 |
| 4,737,103 | | 4/1988 | Siccardi | 432/222 |
| 4,931,948 | | 6/1990 | Parker et al. | 364/505 |
| 4,995,307 | | 2/1991 | Floyd | 98/34.5 |
| 5,031,515 | | 7/1991 | Niemela et al. | 98/34.6 |
| 5,080,282 | | 1/1992 | Harmon | 236/13 |
| 5,117,899 | | 6/1992 | Skimehorn | 165/48.1 |
| 5,324,229 | | 6/1994 | Weisbecker | 454/233 |
| 5,368,521 | | 11/1994 | Koenig | 454/261 |
| 5,385,031 | | 1/1995 | Kizawa et al. | 62/186 |

* cited by examiner

*Primary Examiner*—William E. Tapolcai
(74) *Attorney, Agent, or Firm*—Renner, Kenner, Greive, Bobak, Taylor & Weber

(57) ABSTRACT

A method of controlling the mixing of outside air and return air, entering an air handling unit, through inlets having dampers, the air handling unit having a coil for conditioning the incoming air and a fan for blowing the conditioned air into a conditioned space, the method including measuring the outside air temperature, and return air temperature, and a minimum coil temperature corresponding to a damper position calculating a correlation values from the outside air, return air, and a minimum temperatures determining a correlation function from the correlation value and damper positions, and using the correlation function to calculate the maximum damper position for an acceptable coil temperature.

14 Claims, 2 Drawing Sheets

SINGLE SENSOR MIXING BOX AND METHODOLOGY FOR PREVENTING AIR HANDLING UNIT COIL FREEZE-UP

TECHNICAL FIELD

The present invention generally relates to control of air mixing in an air handling unit. More specifically, the present invention relates to preventing coil freeze-up caused by a stratified air supply entering the air handling unit. Most specifically, the present invention relates to a method for controlling the outside and return air dampers associated with an air handling unit to prevent air handling unit coil freeze-up during sub-freezing weather conditions.

BACKGROUND OF THE INVENTION

In an air handling unit, outside or ventilation air and return air from the conditioned space are mixed, conditioned, and blown out of the air handling unit to the conditioned space. Typically, the outside and return air streams are mixed in a separate mixing box before entering the air handling unit. Once inside the air handling unit, the mixed streams of air pass through a filter, and then are conditioned by a plurality of heating or cooling coils. Once conditioned, the air is supplied to a conditioned space by a blower.

Unfortunately, when incoming air becomes stratified, or separated into layers having different temperatures, sub-freezing layers of air can freeze the conditioning coil, causing damage to the air handling unit. The likelihood of stratification increases in proportion to a temperature difference between the outside and return air streams. Stratification may cause nuisance trips of low temperature safety thermostats or incorrect control of air distribution when sensors cannot read the true mix temperature of the air stream, but most detrimentally, a combination of poor mixing and sub-freezing air streams can lead to freeze-up of a part of the chilled or hot water coils. Coil freeze-up greatly reduces effective heating or cooling capacity of the coil and, in serious cases, can lead to ruptured coils that require expensive repair or replacement. As one would expect, nuisance trips and coil freeze-ups are common during extreme cold weather conditions.

To prevent coil freeze-up, the installation of preheat coils in condensate traps, along with relocation of the coil, have been used help reduce the chances of coil freeze-up. Or, since stratification of the incoming air streams is believed to be a principal cause of nuisance trips and coil freeze-up, some known devices have attempted to reduce stratification by improved air mixing. Unfortunately, these solutions do not completely eliminate coil freeze-ups.

U.S. Pat. No. 5,031,515 describes a method for regulating outside air. This patent incorporates a conventional mixing chamber having an outside air damper and a room air damper. The patent adds an additional or relocated outlet air damper to improve control of the ratio of outside and return air within the total airflow. While this system is useful in obtaining desired ratios of return and outside air, it, unfortunately, does not provide instruction as to how to reduce air stratification.

U.S. Pat. No. 5,324,229 describes an air handling unit containing two fans and four sets of dampers. By controlling the damper position and air handler geometry, this patent improves mixing and reduces stratification by increasing the velocity of the cold outside air streams. Unfortunately, this patent requires replacement of existing air handling units to reduce the effects of stratification.

To further prevent coil freeze-up, known systems measure temperatures at several points within an air handling unit. Some known systems attempt to prevent coil freeze-up by installing sensors on or near the coil. But, due to large coil surface area, it is difficult to pinpoint the coldest location for a given set of operating conditions. Systems having sensors on the coil face prevent freeze-up by shutting off the air handling unit when an undesirable coil face temperature is reached. Disadvantageously, this form of control generally requires human oversight to reset the controller and/or to make sure that favorable conditions exist before turning the air handling unit on.

Consequently, there is a need for a method of ensuring that sub-freezing conditions are avoided at the coil face, without the need for sensors on the coil face while an air handling unit is in operation. There is a further need for a method of preventing freeze-up that utilizes fewer sensors and/or eliminates reliance on low-limit or shutdown sensor technology. Still a further need exists for a method of reducing stratification that does not require air handling unit replacement.

SUMMARY OF THE INVENTION

It is thus an object of the present invention to provide a method of reducing the likelihood of coil freeze-up.

It is another object of the present invention to provide a method of reducing the occurrence of coil freeze-up without using coil face sensors during operation of the air handling unit.

It is a further object of the present invention to provide a method of reducing the occurrence of nuisance trips.

It is yet another object of the present invention to provide a method of preventing freeze-up utilizing fewer sensors.

It is yet another object of the present invention to provide a method of preventing freeze-up with reduced reliance on low limit or shutdown sensors.

It is still another object of the present invention to provide a method of reducing the occurrence of nuisance trips and freeze-ups without replacing existing air-handling units.

At least one of the foregoing and other objects of the present invention, which will become apparent as the detailed description proceeds, are achieved by a method for controlling the mixing of outside air and return air entering an air handling unit through inlets having dampers, the air handling unit having a coil for conditioning the incoming air and a fan for blowing the conditioned air into a conditioned space, the method including measuring the outside temperature and return air temperature, and minimum coil temperature corresponding to a damper position; calculating a correlation value from the outside air, return air and minimum coil temperatures; determining a correlation function from the correlation value and damper position; and using the correlation function to calculate the maximum damper position for an acceptable coil temperature.

Other aspects of the present invention are attained by a testing apparatus for commissioning an air handling unit having an outside air inlet, a return air inlet, a conditioning coil, and a fan, the apparatus including a first temperature sensor positioned near the outside air inlet, a second temperature sensor positioned near the return air inlet, and a third temperature sensor located near the coil, wherein the sensors communicate with a controller.

These and other objects of the present invention, as well as the advantages thereof over existing prior art forms, which will become apparent from the description to follow, are accomplished by the improvements hereinafter described and claimed.

DETAILED DESCRIPTION OF THE INVENTION

Figure 1:
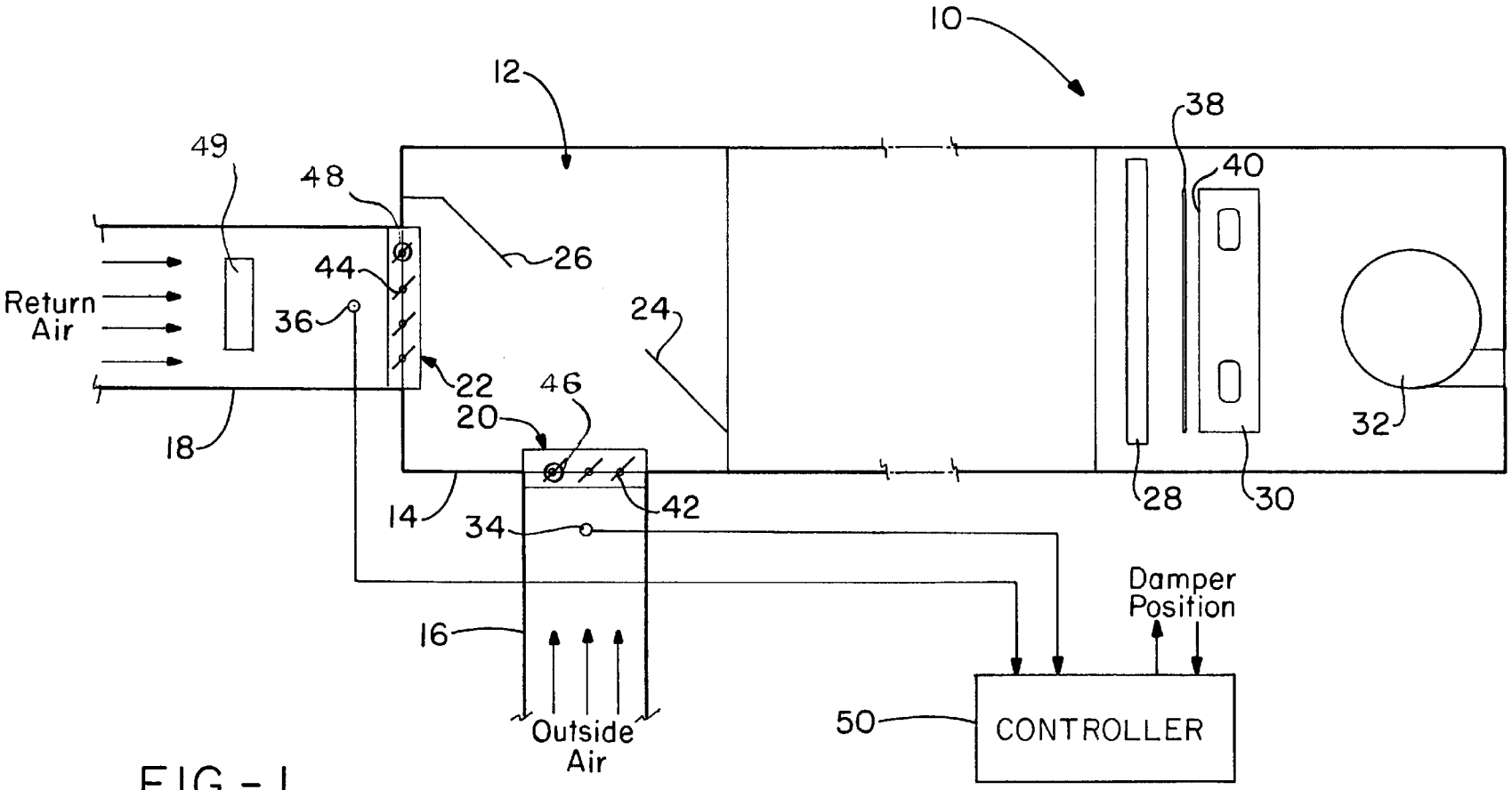
FIG. 1 schematically depicts an air handling unit and mixing box showing one exemplary placement of senors used in the methodology of the present invention.

FIG. 1 schematically illustrates an air handling unit 10 and mixing box 12. The mixing box 12 includes a housing 14 that contains intake ducts 16, 18 for receiving air. As shown, the intake ducts include an outside air duct 16 and a return air duct 18. The outside air duct 16 receives ventilation air or air from outside of the conditioned space, typically outside air, and return air duct 18 receives air from the conditioned space and returns it to the air handling unit 10. Mixing of the outside air and return air streams may occur within the air handling unit 10, or as illustrated in FIG. 1, mixing may be performed in a mixing box 12. The intake ducts 16, 18 may be provided with damper assemblies at the mixing box outside air inlet and return air inlet 20, 22 to aid in mixing the incoming air streams and control the respective amounts of outside and return air entering the air handling unit 10.

Once mixed, the air enters the air handling unit 10 passing through a filter 28 and over conditioning coils 30. Heat transfer occurs at the conditioning coil 30, and then the conditioned air is blown into the conditioned space by a fan 32. Conventional ductwork may be used to channel the air into and out of the air handling unit 10. At times, the outside air may be below the freezing point raising concerns of coil freeze-up and other associated problems. Since it is not always possible to sufficiently mix the air entering the air handling unit 10, the air may become stratified into temperature layers within the incoming air stream. The likelihood of stratification increases in proportion to the temperature difference between the outside and return streams.

To alleviate or prevent problems caused by stratification, the present method controls the proportionate amounts of outside and return air entering the air handling unit 10. This control is effected by a correlation between the damper position and the air temperatures.

To determine the correlation for a given air handling unit 10, as illustrated in the FIG. 1, the present method employs a first temperature sensor 34 in the outside air duct 16, upstream of the mixing box outside air dampers 42. The method further employs a second temperature sensor 36 in the return air duct 18, upstream of the mixing box return air dampers 44. A grid or array of temperature sensors 3 8 is temporarily placed in a plane substantially parallel to the conditioning coil 30 closest to the entrance of the air handling unit 10. Any number of sensors may be used in grid 38 to locate the coldest temperature at the coil face 40. Moreover, a rectilinear grid is not necessary and any array configuration may be used to identify the lowest temperature. A grid 38 is used because the temperature at the coil face 40 generally varies over the area of the face 40. It is envisioned that if the temperatures across the coil face 40 are essentially uniform, a single sensor may be used in place of grid 38. To measure the temperatures near coil face 40, grid 38 is placed near the conditioning coil 30 and preferably within about 1 or 2 inches of the coil face 40.

Position sensors shown schematically and indicated by numerals 46, 48 are used to measure the air damper positions. A first position sensor 46 monitors the outside air dampers 42 and a second sensor 48 may be used to measure the position of the return air dampers 44. It is contemplated that the outside dampers 42 and return dampers 44 may be connected, such that, the position of the outside damper 42 corresponds to a given position of the return damper 44. In this situation, a single position sensor 46 or 48 may be used to calculate the positions of both the outside air damper and return air damper positions. It should be understood that the damper position may be measured manually.

A duct heater 49 may be installed in either the outside or return air duct 16, 18. This heater 49 may be temporarily installed to generate temperature differences between the outside air and the return air streams at the mixing box inlets 20, 22. Alternatively, the testing, described below, may be performed at two or more outside air temperatures.

Finally, a conventional controller 50 records the temperatures during testing. Controller 50 may further receive damper position from the damper position sensors 46, 48, and control their position as will be described below.

At any time other than normal operation of the system, the system is commissioned as follows. Test data including temperature values of the air streams is taken. To that end the air handling unit fan 32 is activated and the dampers 42, 44 are set in a position within their range of motion. With the fan 32 activated, relatively cool ventilation air is drawn into the mixing box 12. The temperature difference between the ventilation air and return air should generally be within the ranges of about 20° F. to about 80° F., about 20° F. to about 50° F, or about 20° F. to about 30° F. If the ventilation air and return air temperatures are not adequately separated a duct heater 49 may be installed and used to generate a satisfactory temperature difference. Once the temperatures achieve an approximate steady state, the temperatures are recorded, manually or by controller 50, at the coil face 40 and at the mixing box inlets 20,22. For each set of temperatures taken, the damper position is recorded. Then, the damper position is changed, and after an approximate steady state is reached, the temperatures and damper positions are measured as before. This process may be repeated for one or more additional damper positions. As will be appreciated, this process may be automated by the controller 50.

Next, a new temperature difference is generated at the mixing box inlets 20, 22. This may be accomplished using different outside temperatures, for example at a different time of day. Or, the duct heater may be operated at a different power level to generate a different temperature difference. The temperatures and damper positions are recorded according to the above procedure.

From the test data, a correlation function $\phi$ is generated as described below. With the data acquired for the damper position and temperature difference at the mixing box inlets 20, 22, a minimum temperature at the coil face 40 is determined from the temperature grid 38. Using this minimum temperature, the outside temperature and the return air temperature in the following equation, a dimensionless quantity $\phi$ is generated for each damper position.

$$\frac{T_{Grid\ Min} - T_{Outside}}{T_{Return} - T_{Outside}} = \phi \qquad \text{(Equation 1)}$$

Figure 2:
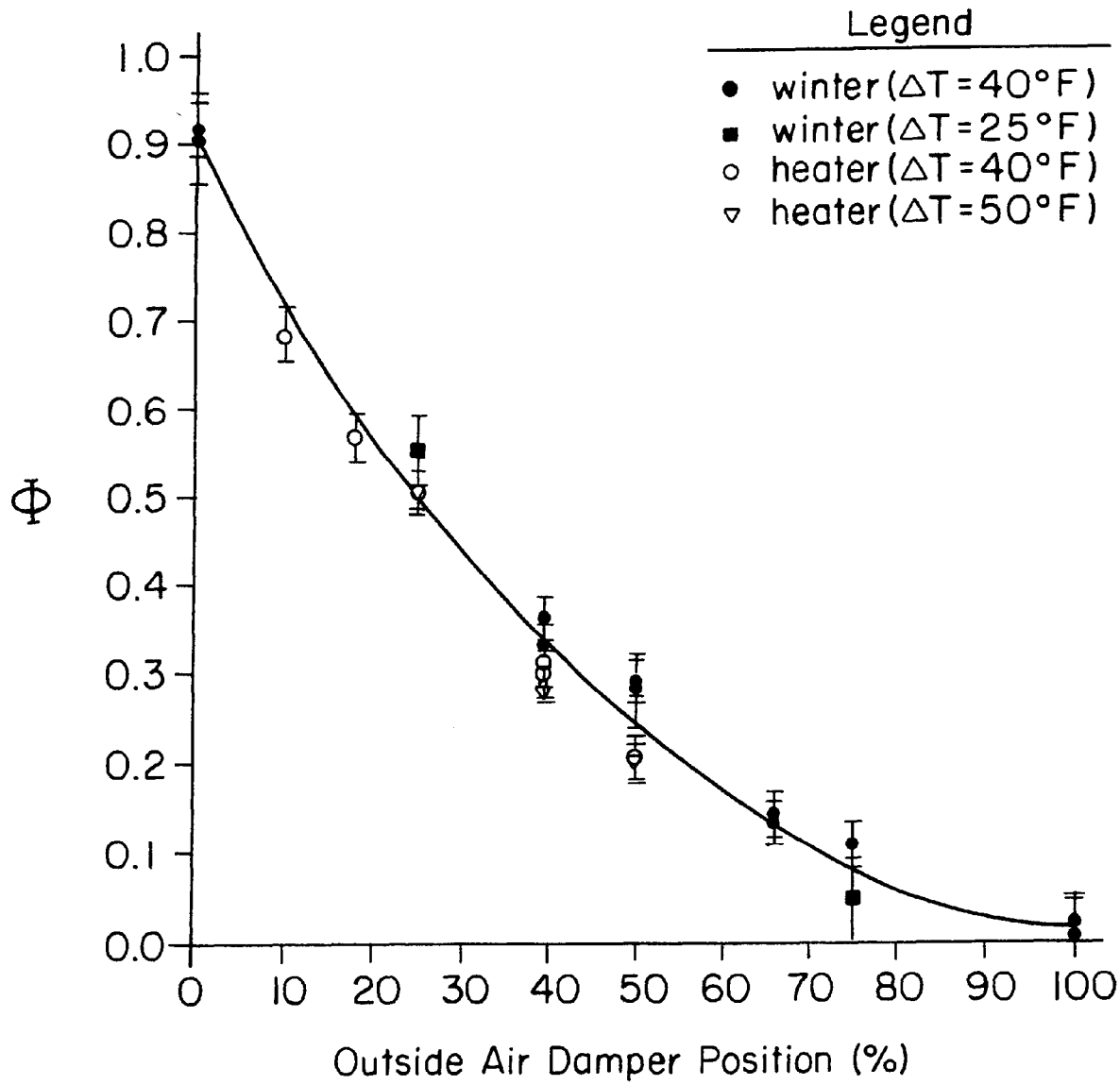
FIG. 2 depicts a best fit curve of a correlation value $\phi$ as a function of damper position applied to four sets of data points where a temperature differential ($\Delta T$) existed between the outside air and return air streams with the notations winter indicating a naturally occurring differential and heater indicating a differential produced by a heating element.

Correlation value $\phi$ is a function of damper position which may be determined graphically or mathematically from the correlation value, and the corresponding damper position. Graphically, the correlation value $\phi$ is plotted against the corresponding damper position. An example of such a plot is shown in FIG. 2. A best fit curve is applied to this plot resulting in the correlation function for controlling the damper position. The best fit correlation may be represented as a mathematical formula and used to determine the proper damper position for given outside and return air temperatures. As can be appreciated this correlation may be programmed into the microprocessor controller 50 to control the dampers 42, 44 in response to different temperature conditions.

From this correlation, a maximum damper position may be determined. This position corresponds to the position of the damper that allows the maximum amount of relatively cold ventilation air to enter the mixing box 12 and avoid sub-freezing temperatures at the coil face 40. This maximum damper position $\phi_{max}$ is calculated according to the following procedure. The ventilation air temperature is measured entering the mixing box 12. The return air temperature is measured entering the mixing box 12. These measurements may be taken simultaneously. A minimum acceptable air temperature at the coil face 40 is defined by the user, for example, to avoid freezing of water, 33° F. may be chosen. It should be appreciated that the user may select other acceptable temperatures based on the coil operating fluid and any safety factor. Using the ventilation temperature, return temperature, and acceptable temperature, a dimensionless quantity is computed according to the following equation.

$$\frac{T_{Acceptable} - T_{Outside}}{T_{Return} - T_{Outside}} = \phi_{\max} \qquad \text{(Equation 2)}$$

$\phi_{max}$ is then used in the correlation function resulting from the data collection method stated above to compute a corresponding damper position. Accordingly, the resulting damper position represents the maximum opening allowable for the outside air damper 42 of the air handling unit 10 for the given outside temperature.

As can be appreciated, after the data collection, generation of the correlation function, and the calculation of $\phi_{max}$ may be programed into the microprocessor controller 50. This controller 50 would receive sensed outside and return air temperatures entering the mixing box 12 and the acceptable temperature as its input. Using this input the controller 50 would generate the correlation function, and calculate the corresponding maximum outside air damper position. It will be appreciated that the generation of the correlation curve and calculation of corresponding maximum outside air damper position may be performed on-site or in a testing laboratory or manufacturing facility, provided that the actual unit installation in the building where it is later operated is similar in terms of how the unit is connected to the indoor and outdoor air ducts. After data collection and recording, the temperature sensor array or grid 38 may be removed from the air handling unit 10 and used for commissioning other units. With the grid 38 removed and the controller 50 programmed, the air handling unit 10 may be put into operation.

During operation, the controller 50 further automates the damper position. With temperature readings from sensors 34, 36, the controller 50 compares the computed damper position with the sensed damper position, and accordingly adjusts the dampers. For example, if the current damper position was larger than the computed damper position, the controller would reduce the damper opening to the computed value. Thus, the controller 50 may be used to continuously control damper position to prevent coil freeze-up.

Notably, the foregoing description describes use of four sensors, namely, the grid 38, outside air temperature sensor 34, return air temperature sensor 36, and damper position sensor 46 or 48. It will be appreciated that one or more of these sensors may be eliminated. For example, the return air temperature may be substantially constant, i.e., equal to the space temperature eliminating the need for return air temperature sensor 34 and damper position may be measured manually during setup. Further, as discussed previously, once the maximum damper position $\phi_{max}$ has been calculated, grid 38 is no longer needed at the coil face and may also be removed.

The following example is for illustrative purposes only, and the present invention is not limited thereto.

EXAMPLE 1

A mixing box manufactured by Micrometal Corporation was tested. This mixing box had rear and side inlets. The box was insulated with one inch, 1.5 pound density, glued and pinned insulation. The damper blades for the box were opposed and the inlets linked, such that, opening one inlet damper closes the opposite inlet damper. During testing, however, the linkages were removed and the dampers were positioned manually. For purposes of the example, the damper positions are set to the maximum outside air damper angular position. The mixing box maximum outside or return damper position was 76 degrees.

The mixing box was attached to a Carrier WEATHERMAKER air handling unit, model number 39LA1061BA1131-R. The designed volume flow rate for this unit is 24,000–36,000 cfm. This unit required a mixing box upstream of the unit. The air handling unit operated at about 1,275 rpm. Two 20 inches by 20 inches by 2 inch KOCH Filter Corporation air filters were placed within the air handling unit adjacent to the coil. For testing purposes, the coil tubes were free of conditioning fluid. Also, the mixed exhaust air exiting the air handling unit is vented into a different room so that the air temperature of the room where the test was performed would remain relatively constant.

As previously described, warm return air was supplied through the rear inlet and cooler outside air was supplied through the right side inlet of the mixing box. The return air was supplied at room temperature through a four foot long rectangular sheet metal duct. Cold outside air passed through a sealed doorway and through a 17 foot long rectangular sheet metal duct. Both return and outside air ducts had the same internal cross sectional area as the corresponding inlets of the mixing box and were internally insulated with 1 inch, 1.5 pound density pinned and glued insulation. The Micrometal mixing box had internal baffles positioned near to the inlet dampers.

The dampers were set to seven damper positions for purposes of testing. These positions are expressed in terms of a percentage of the maximum angular damper position. At each position, the air temperature at the coil face was measured using a grid of 32 resistance temperature detectors (4 rows by 8 columns) placed about 1 inch from the coil face. The resistance temperature detectors were nickel wire sensors manufactured by Johnson Controls Model TE-6000-2. The resistance tolerances of these sensors were plus or minus 1.0 percent at 70° F. The sensors were used with METASYS control panels from Johnson Controls. These control panels received analog signals from the sensors and converted them into digital signals. For every six sensors, one control panel was used. METASYS COMPANION trend data acquisition software monitored and processed the data from the sensors. A sampling rate of 168 samples per minute was used. A single sensor was placed at the two inlet ducts.

To obtain temperature data, the dampers were set, the air handling unit fan turned on, and the system was brought to an approximate steady state thermal condition. Then, temperature was collected each minute for a period of 10 minutes from all of the temperature sensors. Data was taken for ten minutes to assure that inlet and coil face temperature conditions were not changing prior to each test.

For the first position, the outside air damper (O.A.) was fully closed (0%) and the return damper was fully open (100%), the return air inlet temperature was measured at 72.29° F. and the outside air temperature was measured at 37.16° F. For these conditions, the grid temperature sensors recorded the temperatures expressed in table 1.

TABLE 1

O.A. 0%, $T_R$ = 72.29° F., and $T_O$ = 37.16° F.

| # of column | Row 1 | Row 2 | Row 3 | Row 4 |
|---|---|---|---|---|
| 1 | 71.61 | 72.12 | 71.82 | 71.63 |
| 2 | 72.16 | 72.15 | 72.17 | 72.3 |
| 3 | 71.18 | 72.04 | 71.86 | 72.32 |
| 4 | 71.87 | 71.79 | 71.71 | 72.52 |
| 5 | 71.30 | 71.99 | 72.38 | 71.76 |
| 6 | 71.49 | 71.10 | 70.71 | 71.44 |
| 7 | 71.08 | 70.93 | 70.87 | 70.44 |
| 8 | 69.83 | 69.71 | 69.38 | 70.51 |

For the second position, 25% outside air damper and 75% return air damper, the return air inlet temperature was measured at 72.38° F. and the outside air temperature was measured at 31.57° F. The grid temperature sensors recorded the temperatures expressed in table 2.

TABLE 2

O.A. 25%, $T_R$ = 72.38° F., and $T_O$ = 31.57° F.

| # of column | Row 1 | Row 2 | Row 3 | Row 4 |
|---|---|---|---|---|
| 1 | 64.48 | 63.88 | 63.19 | 63.76 |
| 2 | 64.28 | 63.14 | 62.67 | 63.56 |
| 3 | 61.91 | 61.65 | 61.02 | 62.38 |
| 4 | 60.69 | 59.51 | 59.51 | 61.88 |
| 5 | 58.30 | 58.24 | 58.63 | 60.60 |
| 6 | 56.48 | 55.89 | 55.31 | 60.04 |
| 7 | 56.08 | 54.96 | 54.02 | 58.91 |
| 8 | 53.94 | 53.69 | 52.18 | 58.36 |

For the third position, 39.5% outside air damper and 60.5% return air damper, the return air inlet temperature was measured at 71.86° F. and the outside air temperature was measured at 31.70° F. The grid temperature sensors recorded the temperatures expressed in table 3.

TABLE 3

O.A. 39.5%, $T_R$ = 71.86° F., and $T_O$ = 31.70° F.

| # of column | Row 1 | Row 2 | Row 3 | Row 4 |
|---|---|---|---|---|
| 1 | 55.95 | 55.64 | 53.98 | 52.54 |
| 2 | 55.21 | 54.55 | 53.98 | 51.93 |
| 3 | 52.83 | 53.36 | 52.75 | 50.69 |
| 4 | 52.29 | 51.84 | 51.83 | 50.55 |
| 5 | 51.50 | 51.51 | 51.24 | 50.35 |
| 6 | 51.06 | 49.93 | 48.61 | 52.25 |
| 7 | 51.87 | 49.61 | 47.79 | 49.85 |
| 8 | 49.12 | 48.36 | 46.25 | 49.81 |

For the fourth position, 50% outside air damper and 50% return air damper, the return air inlet temperature was measured at 71.92° F. and the outside air temperature was measured at 31.25° F. The grid temperature sensors recorded the temperatures expressed in table 4.

TABLE 4

O.A. 50%, $T_R$ = 71.92° F., and $T_O$ = 31.25° F.

| # of column | Row 1 | Row 2 | Row 3 | Row 4 |
|---|---|---|---|---|
| 1 | 49.43 | 49.65 | 48.95 | 48.55 |
| 2 | 48.58 | 48.71 | 49.02 | 48.63 |
| 3 | 46.37 | 47.91 | 47.78 | 47.94 |
| 4 | 46.36 | 46.82 | 46.78 | 47.77 |
| 5 | 45.85 | 46.95 | 46.65 | 47.46 |
| 6 | 46.25 | 45.75 | 44.18 | 48.10 |
| 7 | 47.78 | 45.62 | 43.71 | 46.63 |
| 8 | 45.59 | 44.67 | 43.10 | 46.41 |

For the fifth position, 66% outside air damper and 34% return air damper, the return air inlet temperature was measured at 71.33° F. and the outside air temperature was measured at 31.35° F. The grid temperature sensors recorded the temperatures expressed in table 5.

TABLE 5

O.A. 66%, $T_R$ = 71.33° F., and $T_O$ = 31.35° F.

| # of column | Row 1 | Row 2 | Row 3 | Row 4 |
|---|---|---|---|---|
| 1 | 40.54 | 41.35 | 40.77 | 39.57 |
| 2 | 40.06 | 40.71 | 41.13 | 39.78 |
| 3 | 38.35 | 40.08 | 40.08 | 39.65 |
| 4 | 38.51 | 38.85 | 39.35 | 39.72 |
| 5 | 38.15 | 38.97 | 39.77 | 39.42 |
| 6 | 38.87 | 37.93 | 37.77 | 40.17 |
| 7 | 41.23 | 38.25 | 37.81 | 39.01 |
| 8 | 38.37 | 37.38 | 37.05 | 39.39 |

For the sixth position, 75% outside air damper and 25% return air damper, the return air inlet temperature was measured at 71.37° F. and the outside air temperature was measured at 31.22° F. The grid temperature sensors recorded the temperatures expressed in table 6.

TABLE 6

O.A. 75%, $T_R$ = 71.37° F., and $T_O$ = 31.22° F.

| # of column | Row 1 | Row 2 | Row 3 | Row 4 |
|---|---|---|---|---|
| 1 | 39.26 | 39.95 | 39.02 | 38.02 |
| 2 | 38.85 | 39.28 | 39.26 | 38.19 |
| 3 | 37.12 | 38.43 | 38.09 | 37.95 |

TABLE 6-continued

| O.A. 75%, $T_R$ = 71.37° F., and $T_O$ = 31.22° F. | | | | |
|---|---|---|---|---|
| # of column | Row 1 | Row 2 | Row 3 | Row 4 |
| 4 | 37.12 | 37.17 | 37.35 | 38.02 |
| 5 | 36.65 | 37.20 | 37.82 | 37.95 |
| 6 | 37.47 | 36.25 | 35.93 | 36.48 |
| 7 | 39.2 | 36.58 | 36.18 | 37.58 |
| 8 | 37.01 | 35.81 | 35.54 | 37.99 |

For the seventh position, 100% outside air damper and 0% return air damper, the return air inlet temperature was measured at 70.88° F. and the outside air temperature was measured at 31.54° F. The grid temperature sensors recorded the temperatures expressed in table 7.

TABLE 7

| O.A. 100%, $T_R$ = 70.88° F., and $T_O$ = 31.54° F. | | | | |
|---|---|---|---|---|
| # of column | Row 1 | Row 2 | Row 3 | Row 4 |
| 1 | 34.21 | 35.45 | 34.99 | 34.46 |
| 2 | 34.04 | 34.95 | 35.02 | 34.46 |
| 3 | 32.75 | 34.62 | 33.50 | 34.02 |
| 4 | 33.32 | 33.50 | 32.85 | 34.21 |
| 5 | 33.32 | 33.76 | 33.70 | 34.45 |
| 6 | 34.42 | 33.08 | 32.36 | 35.63 |
| 7 | 34.74 | 33.66 | 33.35 | 34.96 |
| 8 | 34.10 | 32.98 | 33.17 | 35.55 |

From this data, it was found that a good correlation existed between the position of the dampers and the temperatures at the coil. The temperature data was inserted into equation 1 and plotted against the respective outside damper position to generate FIG. 2, and a best fit curve was applied to this plot using a least square curve fitting technique to determine the minimum temperature at the coil for any outside temperature and damper position.

Thus, it can be seen that at least one of the objects of the invention has been satisfied by the structure and its method for use presented above. While only one embodiment has been presented and described in detail, it is to be understood that the invention is not limited thereto or thereby. It should be apparent that modification of the present invention may be made without escaping the spirit of this invention. Accordingly, for an appreciation of the scope of the invention, reference should be made to the following claims.

What is claimed is:

1. A method for controlling the mixing of outside air and return air entering an air handling unit through inlets having dampers, the air handling unit having a coil for conditioning the incoming air and a fan for blowing the conditioned air into a conditioned space, the method comprising:

a. measuring the outside air temperature, return air temperature, and minimum coil temperature corresponding to a damper position;

b. calculating a correlation value from the outside air, return air, and minimum coil temperatures;

c. generating a correlation function from the correlation value and damper position; and d. using the correlation function to calculate the maximum damper position for an acceptable coil temperature.

2. The method of claim 1, wherein before calculating the correlation value, the method further comprises measuring the outside air temperature, return air temperature, and minimum coil temperature for a plurality of damper positions.

3. The method of claim 1, wherein calculating the correlation value includes dividing a difference between the minimum temperature and the outside air temperature by a second difference between the return air temperature and the outside air temperature.

4. The method of claim 1, wherein calculating the maximum damper position includes:

measuring the operating outside air temperature during operation, and measuring the operating return air temperature during operation;

using the acceptable coil temperature and the operating temperatures to generate an acceptable correlation value substituting the acceptable temperature value into the correlation function to determine the maximum damper position.

5. The method of claim 1, wherein the outside air temperature and the return air temperature are different defining a temperature differential.

6. The method of claim 5, wherein a heater is used to generate the temperature differential.

7. The method of claim 5, wherein said temperature differential is in a range of about 20° F. to about 80° F.

8. The method of claim 7, wherein said temperature differential is in the range of about 20° F. to about 50° F.

9. The method of claim 8, wherein the temperature differential is in the range of about 20° F. to about 30° F.

10. The method of claim 1, wherein the outside air temperature is measured with a first sensor and the return air temperature is measured with a second sensor.

11. The method of claim 1, wherein the minimum coil temperature is determined by measuring the temperature near the coil with a grid of temperature sensors using the lowest temperature sensed by said grid as in the minimum coil temperature.

12. The method of claim 11, wherein said grid comprises four rows and eight columns of temperature sensors.

13. The method of claim 1, wherein the outside air temperature and return air temperature are measured by respective thermocouples and the minimum coil temperature is measured by a grid of thermocouples all of said thermocouples communicating with a controller.

14. The method of claim 13, wherein said controller calculates said correlation value.

* * * * *

UNITED STATES PATENT AND TRADEMARK OFFICE
Certificate

Patent No. 6,318,096 B1 Patented: November 20, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Richard J. Gross, Akron, OH; and Steven P. Rooke, Fishers, IN.

Signed and Sealed this Third Day of June 2003.

IRA S. LAZARUS
*Supervisory Patent Examiner*
Art Unit 3749